US007992471B2

(12) United States Patent
Tsai

(10) Patent No.: US 7,992,471 B2
(45) Date of Patent: Aug. 9, 2011

(54) POSITIONING APPARATUS FOR HAND TOOL

(76) Inventor: Ming-Ching Tsai, Taichung (TW)

( * ) Notice: Subject to any disclaimer, the term of this patent is extended or adjusted under 35 U.S.C. 154(b) by 334 days.

(21) Appl. No.: 12/471,402

(22) Filed: May 24, 2009

(65) Prior Publication Data

US 2010/0294090 A1 Nov. 25, 2010

(51) Int. Cl.
*B25B 23/16* (2006.01)

(52) U.S. Cl. ..... 81/177.9

(58) Field of Classification Search ..... 81/177.7, 81/177.8, 177.9
See application file for complete search history.

(56) References Cited

U.S. PATENT DOCUMENTS

| | | | | |
|---|---|---|---|---|
| 6,167,787 | B1 * | 1/2001 | Jarvis | 81/177.2 |
| 6,220,125 | B1 * | 4/2001 | Lan | 81/177.9 |
| 7,174,815 | B1 * | 2/2007 | Hsieh | 81/177.9 |
| 7,472,631 | B1 * | 1/2009 | Wu | 81/177.9 |

* cited by examiner

*Primary Examiner* — Debra S Meislin

(57) ABSTRACT

A positioning apparatus for hand tool includes a shank, a driving head, a switch, and a positioning device. The shank has a connecting end having a receiving space and a slot communicated with the receiving space. The driving head has multiple positioning holes. The switch includes a screw. The positioning device is received in the receiving space. The positioning device includes a spring, a pusher, and a base. The base is received in the receiving space. The base has a recess for receiving the spring and the pusher and a slot communicated with the recess. The spring has one end abutting against a bottom of the recess and the other end abutting against the pusher. The screw passes the switch and fastens with the pusher via the slot in the shank and the slot in the base. The pusher selectively engages with one of the multiple positioning holes.

11 Claims, 8 Drawing Sheets

POSITIONING APPARATUS FOR HAND TOOL

BACKGROUND OF THE INVENTION

1. Field of the Invention

The present invention relates to a hand tool, and more particularly to a positioning apparatus for hand tool.

2. Description of Related Art

A conventional positioning apparatus for hand tool in accordance with the prior art comprises a shank and a driving head connected to one end of the shank. The shank has two ears extended therefrom for pivotally connecting the driving head. The shank has a bore defined therein and facing the driving head. A spring and a ball sequentially received in the bore. The driving head has multiple holes defined therein and facing the shank. The ball selectively engages with one of the multiple holes. The bore is mad by drilling; therefore the inner surface of the bore is rough. The ball and the spring are affected by the rough inner surface such that the ball and the spring move unsmoothly. The operation of the conventional positioning apparatus is unsmooth and imprecise. Furthermore, the engagement between the ball and the hole is unstable. When the driving head looses from the ball, user can not easily apply force to fasten/unfasten a screw.

The present invention has arisen to mitigate and/or obviate the disadvantages of the conventional positioning apparatus.

SUMMARY OF THE INVENTION

The main objective of the present invention is to provide an improved positioning apparatus for hand tool.

To achieve the objective, the positioning apparatus for hand tool includes a shank, a driving head connected to the shank, a switch connected to the shank, and a positioning device connected to the shank. The shank has a connecting end defined in one end thereof. The connecting end has a receiving space defined therein and a slot defined in a lateral thereof. The slot is communicated with the receiving space. The driving head has multiple positioning holes defined therein. The switch includes a screw. The positioning device is received in the receiving space. The positioning device includes a spring, a pusher, and a base. The base is received in the receiving space. The base has a recess defined therein for receiving the spring and the pusher. The base has a slot defined in a lateral thereof and communicated with the recess. The slot in the base is corresponding to the slot in the shank. The spring has one end abutting against a bottom of the recess and the other end abutting against the pusher. The screw passes the switch and fastens with the pusher via the slot in the shank and the slot in the base. The pusher selectively engages with one of the multiple positioning holes.

Further benefits and advantages of the present invention will become apparent after a careful reading of the detailed description with appropriate reference to the accompanying drawings.

DETAILED DESCRIPTION OF THE INVENTION

Figure 1:
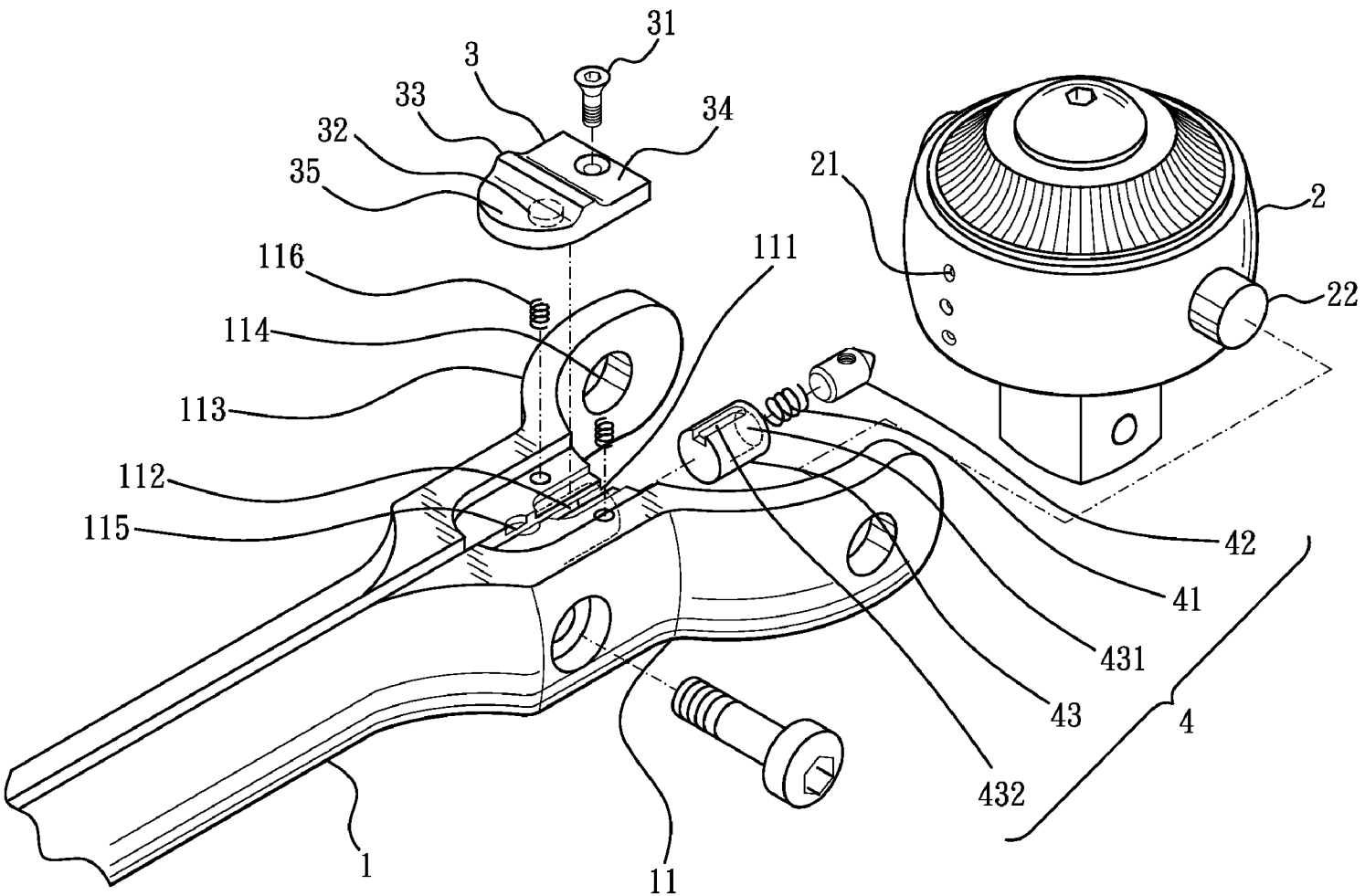
FIG. 1 is an exploded perspective view of a positioning apparatus for hand tool in accordance with the present invention.
Figure 2:
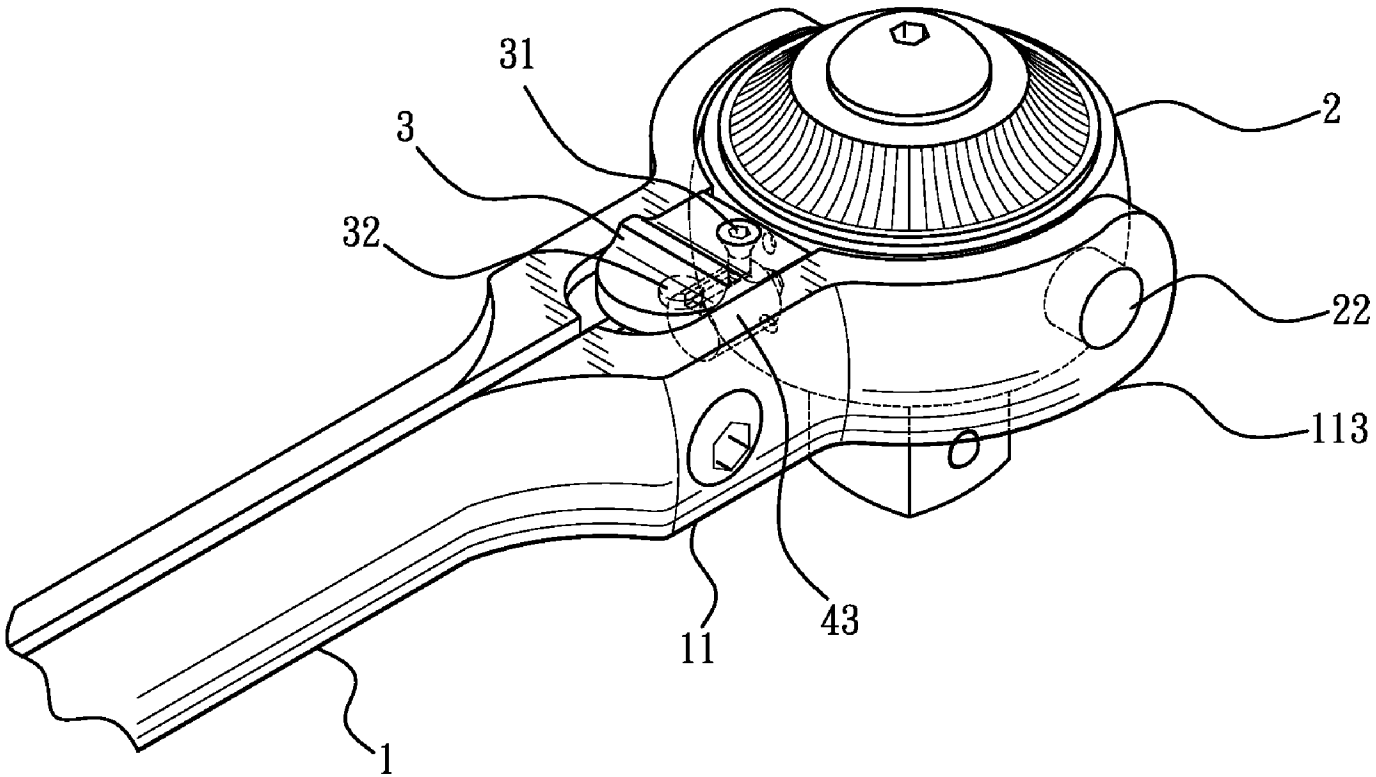
FIG. 2 is an assembled perspective view of the positioning apparatus for hand tool in accordance with the present invention.

Referring to the drawings and initially to FIGS. 1-7, a positioning apparatus for hand tool in accordance with the present invention comprises a shank 1, a driving head 2 connected to the shank 1, a switch 3 connected to the shank 1, and a positioning device 4 connected to the shank 1.

The shank 1 has a connecting end 11 defined in one end thereof for connecting to the driving head 2, the switch 3, and the positioning device 4. The connecting end 11 has a receiving space 111 defined therein for receiving the positioning device 4. The connecting end 11 has a slot 112 defined therein and communicated with the receiving space 111. The connecting end 11 has two ears 113 extended therefrom. Each ear 113 has a through hole 114 defined therein. The driving head 2 is disposed between the two ears 113.

The driving head 2 is a D-head of a ratchet wrench. The driving head 2 has multiple positioning holes 21 defined in a lateral thereof and facing the connecting end 11. The driving head 2 has two protrusions 22 extended from the lateral thereof. Each protrusion 22 is corresponding to one of the two through holes 114 and received in the corresponding one through hole 114 for pivotally connecting the driving head 2 with the shank 1.

The switch 3 is disposed in the connecting end 11. The switch 3 includes a screw 31. The screw 31 passes the switch 3 and fastens with the positioning device 4 via the slot 112. The switch 3 has a male protrusion 32 extended therefrom. The shank 1 has a female recess 115 defined in the connecting end 11. When the switch 3 moves along the slot 112, the male protrusion 32 selectively engages with the female recess 115. The shank 1 has at least one spring 116 disposed in connecting end 11. The at least one spring 116 has one end abutting against the connecting end 11 and the other end abutting against the switch 3 such that the male protrusion 32 is pushed to disengage with the female recess 115. The switch 3 has a rib 33 formed therein. The switch 3 is divided into a first surface 34 and a second surface 35 by the rib 33. The first surface 34 is provided to be pulled by finger. The second surface 35 is provided to be pushed by finger. The rib 33 is used to increase the friction between the finger and the switch 3 such that user pulls/pushes the switch 3 easily.

The positioning device 4 includes a spring 41, a pusher 42, and a base 43. The base 43 has a recess 431 defined therein for receiving the spring 41 and the pusher 42. The base 43 has a slot 432 defined in a lateral thereof and communicated with the recess 431. The slot 432 is corresponding to the slot 112 in the connecting end 11. The spring 41 has one end abutting against a bottom of the recess 431 and the other end abutting against the pusher 42 to urge the pusher 42 toward the driving head 2. The screw 31 passes the slot 432 and fastens with the pusher 42 such that the pusher 42 moves with the switch 3. The pusher 42 selectively engages with one of the multiple positioning holes 21 such that the driving head 2 is positioned in a predetermined angle relative to the shank 1.

Figure 4:
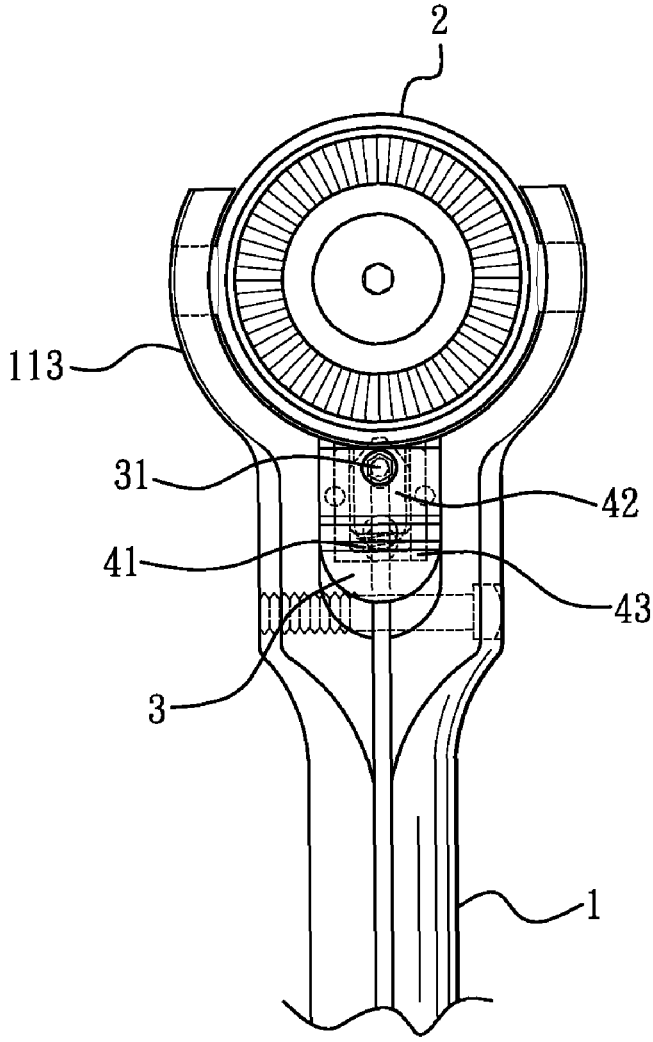
FIG. 4 is a top elevational view of the positioning apparatus for hand tool in accordance with the present invention.
Figure 3:
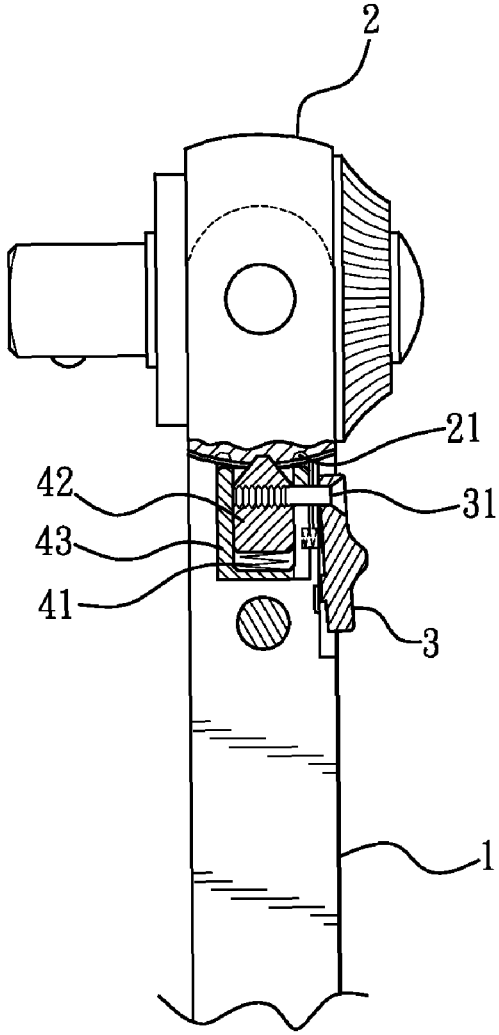
FIG. 3 is a partial cross-sectional view of the positioning apparatus for hand tool in accordance with the present invention.
Figure 6:
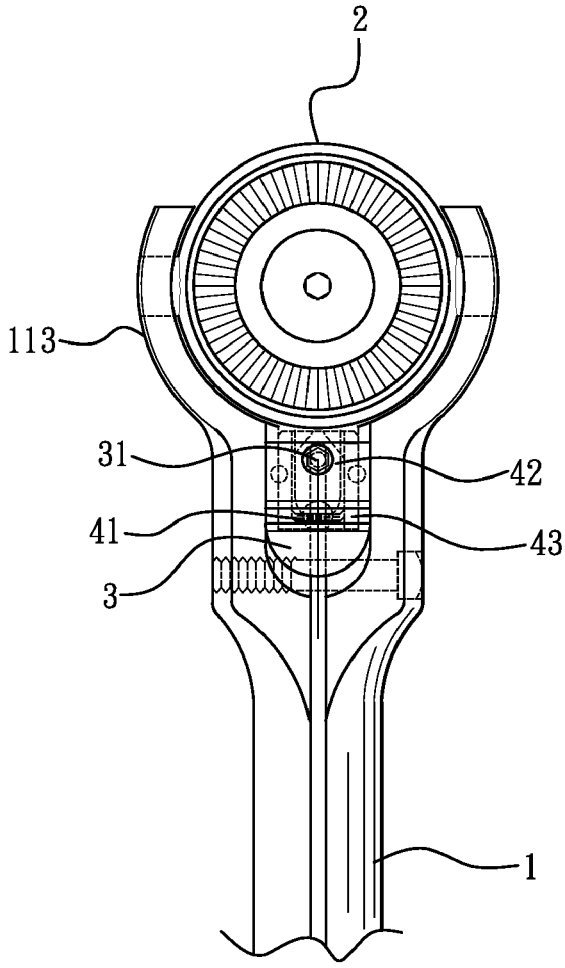
FIG. 6 is an operational top elevational view of the positioning apparatus for hand tool, showing that the pusher disengages with the positioning hole.
Figure 5:
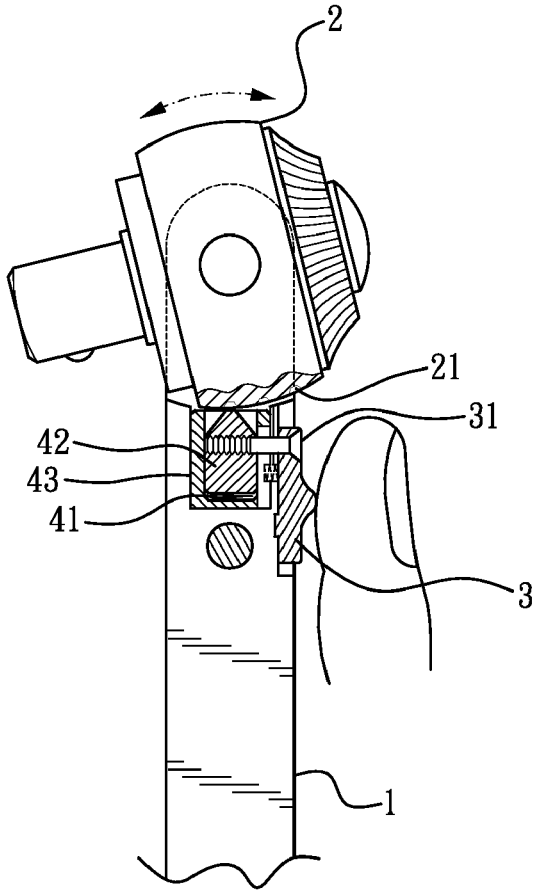
FIG. 5 is an operational partial cross-sectional view of the positioning apparatus for hand tool, showing that the pusher disengages with the positioning hole.
Figure 7:
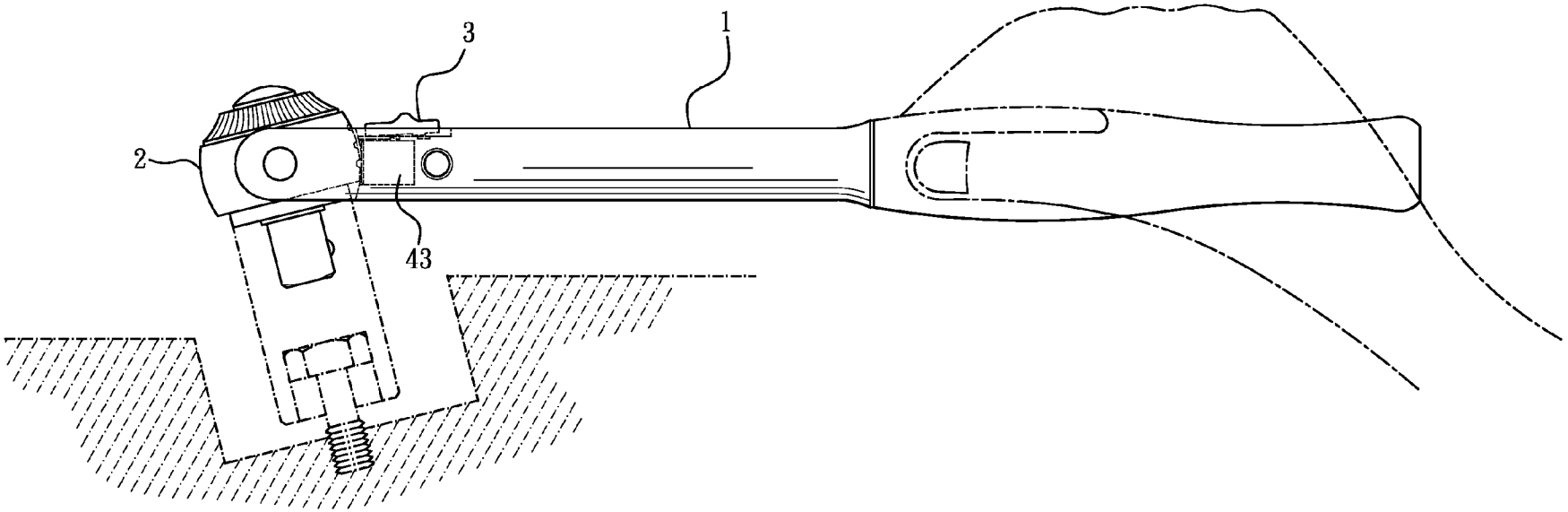
FIG. 7 shows the operation of the hand tool.

Referring to FIGS. 3-7, the operation of the positioning apparatus for hand tool in accordance with the present invention is illustrated. FIGS. 3-4 show the pusher 42 engages with one of the multiple positioning holes 21. The spring 41 provides an elastic force to push the pusher 42 toward the driving head 2. One end of the pusher 42 is tapered to easily and firmly engage with the positioning hole 21. The spring 116 pushes the switch 3 such that the male protrusion 32 disengages with the female recess 115. When user pulls the switch 3, the pusher 42 moves away from the positioning hole 21 to disengage with the positioning hole 21 as shown in FIG. 5. When pressing the switch 3, the male protrusion 32 engages with the female recess 115. The driving head 2 is free to rotate relative to the shank 1. When the driving head 2 is adjusted to the desired angle, user releases the switch 3. The switch 3 is pushed by the spring 116 to disengage the male protrusion 32 with the female recess 115. The pusher 42 and the switch 3 are pushed by the spring 41 to engage the pusher 42 with the positioning hole 21. The base 43 is firmly received in the receiving space 111. An inner peripheral of the recess 431 in the base 43 is smooth. The spring 41 and the pusher 42 are movably received in the base 43 such that the movements of the spring 41 and the pusher 42 are smoothly and easily.

Figure 8:
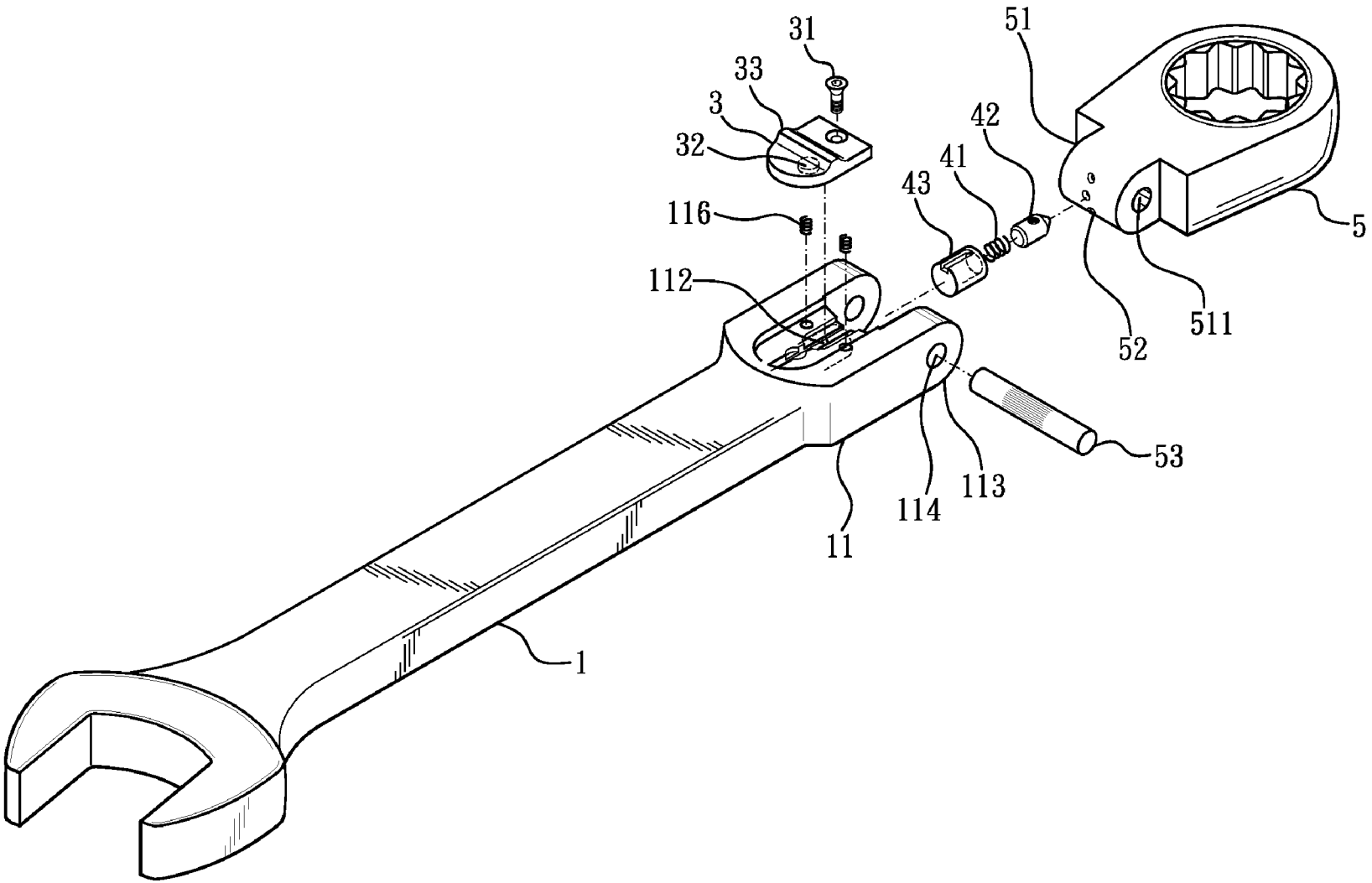
FIG. 8 is an exploded perspective view of a second embodiment of a positioning apparatus for hand tool in accordance with the present invention.

Referring to FIG. 8, a second embodiment of a positioning apparatus for hand tool is illustrated. The elements and the efforts which are the same with the first embodiment are not described, only the differences are described. The driving head 5 has a polygonal recess. The driving head 5 has a connecting protrusion 51 extended therefrom. The connecting protrusion 51 has a through hole defined therein. The connecting protrusion 51 has multiple positioning holes 52 defined in a lateral thereof. A pin 53 passes the ear 113 and the through hole 511 to pivotally connect the driving head 5 with the shank 1.

Figure 9:
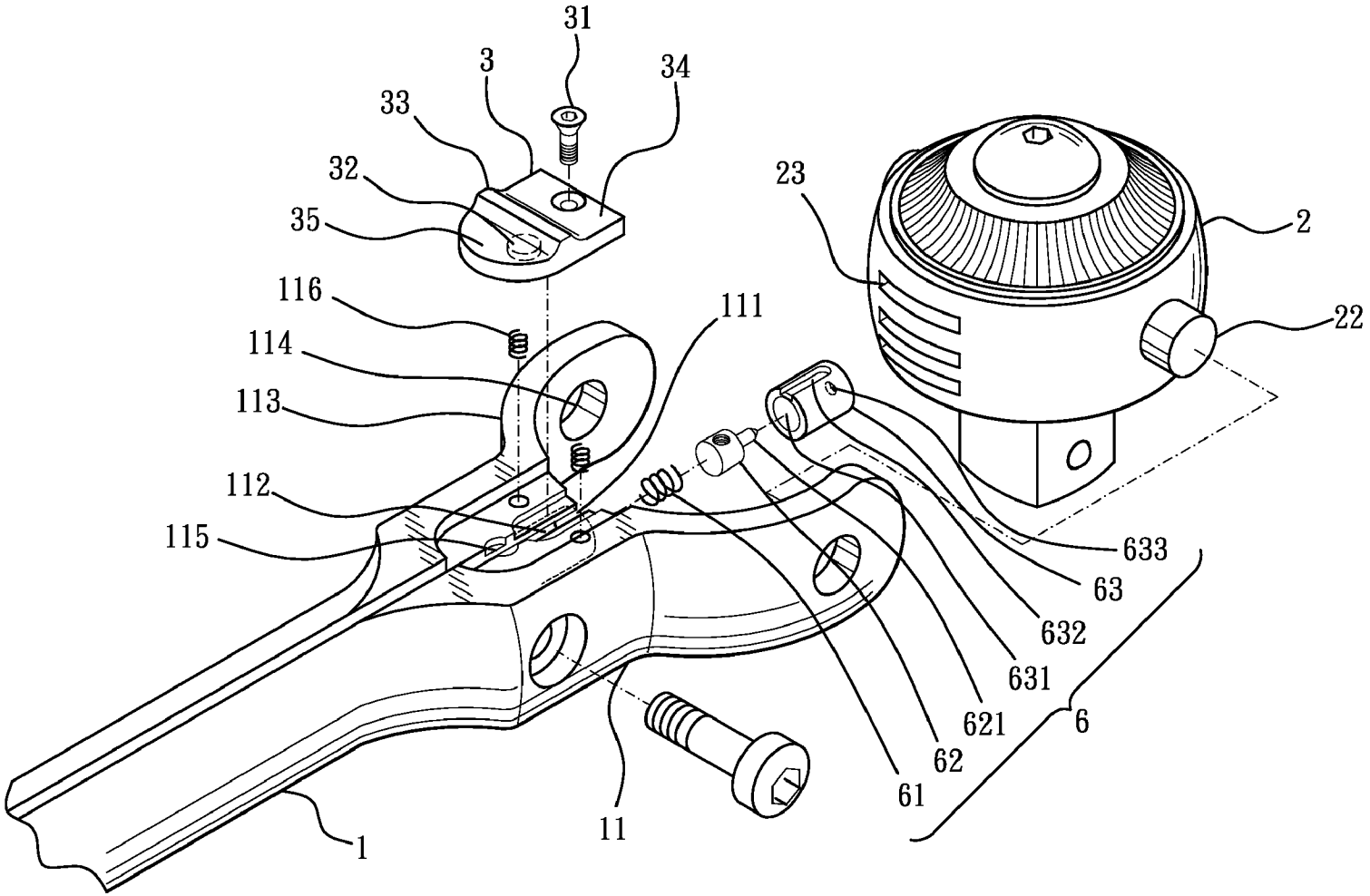
FIG. 9 is an exploded perspective view of a third embodiment of a positioning apparatus for hand tool in accordance with the present invention.
Figure 11:
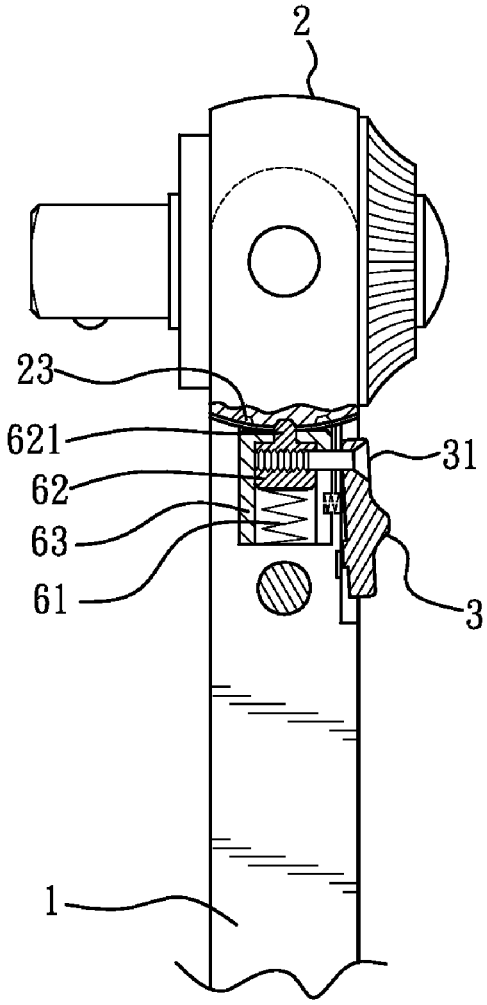
FIG. 11 is a top elevational view of the third embodiment of the positioning apparatus for hand tool in accordance with the present invention.
Figure 10:
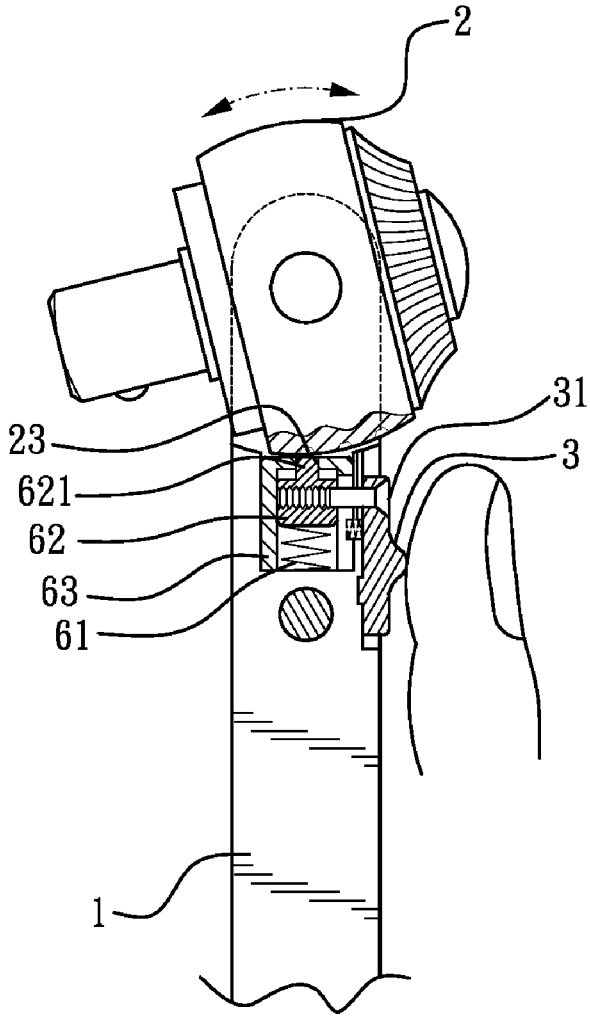
FIG. 10 is a partial cross-sectional view of the third embodiment of the positioning apparatus for hand tool in accordance with the present invention.

Referring to FIG. 9-11, a third embodiment of a positioning apparatus for hand tool is illustrated. The elements and the efforts which are the same with the first embodiment are not described, only the differences are described. The driving head 2 has multiple positioning slots 23 defined in a lateral thereof. The positioning device 6 includes a spring 61, a pusher 62, and a base 63. The base 63 is received in the receiving space 111. The base 63 has a recess 631 defined therein and a slot 632 defined in a lateral thereof and communicated with the recess 631. The base 63 has a through hole 633 defined in a bottom of the recess 631. The spring 61 has on end abutting against a bottom of the receiving space 111 and the other end abutting against the pusher 62 to push the pusher 62 toward the driving head 2. The pusher 62 has a protrusion 621 extended therefrom and passing the through hole 633 such that the protrusion 621 selectively engages with one of the multiple positioning slots 23.

Although the invention has been explained in relation to its preferred embodiment, it is to be understood that many other possible modifications and variations can be made without departing from the spirit and scope of the invention as hereinafter claimed.

What is claimed is:

1. A positioning apparatus for hand tool comprising:

a shank, the shank having a connecting end defined in one end thereof, the connecting end having a receiving space defined therein and a slot defined in a lateral thereof, the slot communicated with the receiving space;

a driving head connected to the connecting end, the driving head having multiple positioning holes defined therein;

a switch connected to the connecting end, the switch comprising a screw; and a positioning device connected to the connecting end and received in the receiving space, the positioning device comprising a spring, a pusher, and a base, the base received in the receiving space, the base having a recess defined therein for receiving the spring and the pusher, the base having a slot defined in a lateral thereof and communicated with the recess, the slot in the base corresponding to the slot in the shank, the spring having one end abutting against a bottom of the recess and the other end abutting against the pusher;

wherein the screw passes the switch and fastens with the pusher via the slot in the shank and the slot in the base; the pusher selectively engages with one of the multiple positioning holes.

2. The positioning apparatus for hand tool as claimed in claim 1, wherein the switch has a male protrusion extended therefrom, the shank having a female slot defined therein, the male protrusion selectively engaged with the female slot.

3. The positioning apparatus for hand tool as claimed in claim 2 further comprising at least one spring disposed between the shank and the switch to urge the switch.

4. The positioning apparatus for hand tool as claimed in claim 1, wherein the switch has a rib formed therein, the switch having a first surface and a second surface defined therein and divided by the rib, the first surface provided for being pulled by finger, the second surface provided for being pushed by finger.

5. The positioning apparatus for hand tool as claimed in claim 1, wherein the connecting end has two ears extended therefrom, each ear having a through hole defined therein, the driving head having two protrusions extended therefrom, each protrusion received in one of the two through holes such that the driving head pivotally connects to the shank.

6. The positioning apparatus for hand tool as claimed in claim 1, wherein the connecting end has two ears extended therefrom, each ear having a through hole defined therein, the driving head having a connecting protrusion extended therefrom, the connecting protrusion having a through hole defined therein, a pin passing through each through hole in each ear via the through hole in the connecting portion such that the driving head pivotally connects to the shank.

7. A positioning apparatus for hand tool comprising:

a shank, the shank having a connecting end defined in one end thereof, the connecting end having a receiving space defined therein and a slot defined in a lateral thereof, the slot communicated with the receiving space;

a driving head connected to the connecting end, the driving head having multiple positioning slots defined therein;

a switch connected to the connecting end, the switch comprising a screw; and a positioning device connected to the connecting end and received in the receiving space, the positioning device comprising a spring, a pusher, and a base, the base received in the receiving space, the base having a recess defined therein for receiving the spring and the pusher, the base having a slot defined in a lateral thereof and communicated with the recess, the slot in the base corresponding to the slot in the shank, the base having a through hole defined in a bottom of the recess, the spring having one end abutting against a bottom of the receiving space and the other end abutting against the pusher, the pusher having a protrusion extended therefrom;

wherein the screw passes the switch and fastens with the pusher via the slot in the shank and the slot in the base; the protrusion protrudes the through hole to selectively engage with one of the multiple positioning slots.

8. The positioning apparatus for hand tool as claimed in claim 7, wherein the switch has a male protrusion extended therefrom, the shank having a female slot defined therein, the male protrusion selectively engaged with the female slot.

9. The positioning apparatus for hand tool as claimed in claim 8 further comprising at least one spring disposed between the shank and the switch to urge the switch.

10. The positioning apparatus for hand tool as claimed in claim 7, wherein the switch has a rib formed therein, the switch having a first surface and a second surface defined therein and divided by the rib, the first surface provided for being pulled by finger, the second surface provided for being pushed by finger.

11. The positioning apparatus for hand tool as claimed in claim 7, wherein the connecting end has two ears extended therefrom, each ear having a through hole defined therein, the driving head having two protrusions extended therefrom, each protrusion received in one of the two through holes such that the driving head pivotally connects to the shank.

* * * * *